US005637207A

United States Patent [19]

Hsing et al.

[11] Patent Number: 5,637,207

[45] Date of Patent: Jun. 10, 1997

[54] FLUID CATALYTIC CRACKING PROCESS

[75] Inventors: Hsu-Hui Hsing, Nederland, Tex.; Jonathan P. Rich, El Dorado, Kans.; Glenn A. Clausen, Port Arthur, Tex.

[73] Assignee: ABB Lummus Global Inc., Bloomfield, N.J.

[21] Appl. No.: 422,567

[22] Filed: Apr. 14, 1995

[51] Int. Cl.[6] ..... C10G 11/20

[52] U.S. Cl. ..... 208/164; 208/108; 208/113; 208/120; 208/153

[58] Field of Search ..... 208/153, 164, 208/113, 108, 120

[56] References Cited

U.S. PATENT DOCUMENTS

| | | | |
|---|---|---|---|
| 4,479,870 | 10/1984 | Hammershaimb et al. | 208/164 |
| 5,017,343 | 5/1991 | Cetinkaya | 208/153 |
| 5,141,625 | 8/1992 | Lomas | 208/164 |
| 5,318,689 | 6/1994 | Hsing et al. | 208/70 |

*Primary Examiner*—Helane Myers

*Attorney, Agent, or Firm*—Chilton, Alix & Van Kirk

[57] ABSTRACT

An intermediate distillate fraction is subjected to fluid catalytic cracking (FCC) to yield liquid fuel and lighter. The $C_7$–$C_{10}$ paraffin lift fluid is converted to $C_2$–$C_5$ olefins and naphtha of enhanced octane.

9 Claims, No Drawings

FLUID CATALYTIC CRACKING PROCESS

BACKGROUND OF THE INVENTION

1. Field of the Invention

The invention is a catalytic process for cracking paraffin fractions to light olefins and naphtha. More particularly the invention is a process for converting paraffins to gasoline by fluid catalytic cracking (FCC).

2. Description of Related Methods in the Field

In the fluid catalytic cracking (FCC) process a petroleum derived hydrocarbon charge stock is contacted with a fluidized finely divided catalyst in a reaction zone. The catalyst is fluidized by means of a lift gas. The charge stock is converted by cracking to lower boiling hydrocarbons and coke. The lower boiling hydrocarbon vapor and spent catalyst are separated in a containment vessel, termed in the art the reactor vessel. Separated spent catalyst is steam stripped of entrained vapor and the remaining spent catalyst coated with a layer of unstrippable coke is passed from the reactor vessel to a catalyst regenerator vessel. There, spent catalyst is regenerated by controlled oxidation of the coke coating to carbon dioxide and carbon monoxide. A hot, active regenerated catalyst is returned to the reaction zone.

Separated lower boiling hydrocarbon vapor, stripped vapor and spent stripping steam is withdrawn from the reactor vessel and passed to a fractionation train where cracked hydrocarbon vapors are separated by fractional distillation into the desired intermediate fractions. Any number of intermediate fractions can be made based on refinery configuration and product demand. For example, product fractions may include a gaseous fraction, naphtha, kerosene, diesel oil, gas oil and vacuum gas oil. Of these fractions, the naphtha fraction is the most desirable because of its use as an automobile fuel blending component. The intermediate fractions comprising kerosene and diesel oil may be used for their fuel value. In the alternative they may be processed to produce additional gasoline blending components. The heavy fractions comprising gas oil and vacuum gas oil may be used for the production of heavy fuel oil. Optionally, a portion of the heavy fraction may be recycled to the fluid catalytic cracking reaction zone to produce additional lower boiling hydrocarbons, including an additional increment of naphtha for gasoline blending.

U.S. Pat. No. 4,422,925 to D. Williams et al. teaches a process for the fluid catalytic cracking (FCC) of a plurality of hydrocarbon feedstocks. In the process a gaseous paraffinic hydrocarbon is used as a lift gas to fluidize a cracking catalyst in a riser (transfer line) reactor. Naphtha and gas oil feedstocks are cracked to yield liquid fuels.

U.S. Pat. No. 3,894,932 to H. Owen teaches a fluid catalytic cracking process for converting a gas oil with Y faujasite catalysts. The catalyst is first suspended in a $C_3$–$C_4$ gaseous hydrocarbon fraction and then contacted with a higher boiling hydrocarbon fraction.

U.S. Pat. Nos. 4,479,870; 4,541,922 and 4,541,923 disclose the use of lift gas in a fluid catalytic cracking (FCC) riser reactor. Certain desirable results are achieved by selecting the composition of the lift gas.

SUMMARY OF THE INVENTION

The invention is a process for catalytically cracking a paraffin fraction to yield light olefins and naphtha.

A finely divided cracking catalyst is fluidized in an initial portion of a vertically elongated riser reactor to produce a catalyst suspension. The catalyst suspension is contacted with a petroleum derived feedstock such as gas oil, vacuum gas oil or mixtures thereof. Reactor effluent is fractionated to yield $C_2$–$C_5$ olefins and naphtha.

The process is characterized in the lift fluid which comprises $C_7$ to $C_{10}$ paraffin, preferably a normal paraffin.

DETAILED DESCRIPTION OF THE INVENTION

Feedstocks for the process are derived from crude petroleum. The source of the crude petroleum is not critical; however, Arabian light and West Texas intermediate are preferred feedstocks in the petroleum refining industry because these petroleums are rather light and have a relatively low viscosity compared with other whole crude petroleums. The viscosity of Arabian light petroleum is about 1.0 cp at 280° F. with a gravity of about 34.5° API. Other whole crude petroleums having a gravity of between about 33° API and 36° API are preferred and are considered premium grade because of their high gravity. In general crude petroleum having a gravity of 30° API and higher are desirable. Crude petroleum having a gravity of 20° API and lower are less desirable though they may be used as feedstocks to produce intermediate distillates for the process.

Crude petroleum is subjected to fractional distillation in fractional distillation towers including a pipe still and a vacuum pipe still with lesser associated distillation towers. The resulting fractions range from the lightest hydrocarbon vapors including methane, ethane, ethylene, propane and propylene to the heaviest vacuum resid having an initial boiling point of 1100° F. (593° C.). Intermediate between propane and propylene and the heavy vacuum resid fractions are a number of intermediate fractions. The cut points of each of these intermediate fractions is determined by refinery configuration and product demand. These intermediate fractions include naphtha, kerosene, diesel oil, gas oil and vacuum gas oil.

In response to refinery configuration and product demand a large body of technology has been developed for the conversion of one intermediate fraction to another. Therefore, any of these intermediate fractions may be the direct product of crude petroleum or be the product of subsequent conversion processes.

According to the invention a crude petroleum is subjected to atmospheric and vacuum distillation to produce intermediate distillate fractions. These include naphtha, kerosene, diesel oil, gas oil and vacuum gas oil. These intermediate distillate fractions may be generally described as having an initial boiling point of about 30° F. or −1.1° C. ($C_4$) and having an end point of about 950° F. (510° C.) depending on the crude petroleum source.

Traditionally gasoline has had a boiling range of 30° F. or 1.1° C. ($C_4$) to 430° F. (221° C.). Naphtha has a boiling range of 90° F. (32.2° C.) to 430° F. (221° C.). Kerosene has a boiling range of 360° F. (182° C.) to 530° F. (276° C.). Diesel has a boiling range of 360° F. (182° C.) to about 650° F.–680° F. (343° C.–360° C.). The end point for diesel is 650° F. (343° C.) in the United States and 680° F. (360° C.) in Europe. Gas oil has an initial boiling point of about 650° F.–680° F. (343° C.–360° C.) and end point of about 800° F. (426° C.). The end point for gas oil is selected in view of process economics and product demand and is generally in the 750° F. (398° C.) to 800° F. (426° C.) range with 750° F. (398° C.) to 775° F. (412° C.) being most typical. Vacuum gas oil has an initial boiling point of 750° F. (398° C.) to 800° F. (426° C.) and an end point of 950° F. (510° C.) to 1100° F. (593° C.). The end point is defined by the hydrocarbon component distribution in the fraction as determined by an ASTM D-86 or ASTM D-1160 distillation. The naphtha, kerosene and diesel portion is referred to in the art collectively as distillate fuel. The gas oil and vacuum gas oil portion is referred to as fluid catalytic cracking (FCC) feedstock or as fuel oil blending stock.

Commercial cracking catalysts for use in a fluid catalytic cracking (FCC) process have been developed to be highly active for the conversion of relatively heavy hydrocarbons such as gas oil and vacuum gas oil into naphtha, gasoline, lighter hydrocarbons such as $C_4$ olefins and coke. One class of such cracking catalysts includes those comprising zeolite silica-alumina molecular sieve in admixture with amorphous inorganic oxides such as silica-alumina, silica-magnesia and silica-zirconia.

This catalyst is regenerated in cyclic reuse according to the FCC process to maintain an ASTM D-3907 micro activity in the range of 60 to 72.

Paraffins comprising $C_7$, $C_8$, $C_9$, $C_{10}$ paraffins and mixtures thereof or a mixture of paraffins and inert gas such as steam or nitrogen in a volumetric ratio of 1:10 to 10:1, preferably 10:1 to 2:1 is combined with cracking catalyst in an initial portion of a vertically elongated riser reactor to produce a catalyst suspension. Paraffin is preferably injected as a liquid which vaporizes when contacted with the hot catalyst. After vaporization, catalyst suspension velocity is about 1.0 to 18 meters per second up the riser. The velocity is controlled by the addition of high pressure nitrogen or steam to bring about the required catalyst suspension velocity. The catalyst to lift fluid weight ratio is also adjusted, generally greater than 5:1 preferably greater than 80:1, most preferably 100:1 to 800:1.

Feedstock for fluid catalytic cracking is any one of the intermediate petroleum distillate fractions which is heavier than gasoline. These are naphtha, kerosene, diesel, gas oil, vacuum gas oil and mixtures thereof. Gas oil is preferred. Additional sources of feedstock are the ebullated bed process, visbreaking, and the delayed coker process which produce distillate fractions by the catalytic hydrocracking or thermal cracking of heavy residual oil stocks.

The catalyst suspension is contacted with the FCC feedstock at a riser reactor temperature of 900° F. (482° C.) to 1200° F. (659° C.) at a pressure of 14.7 psia (1 arm) to 114.7 psia (7.8 atm) and a residence time of 0.05 to 20 seconds. The preferred riser reactor temperature is about 900° F. (482° C.) to 1100° F. (593° C.) to yield a liquid fuel and lighter fraction. The liquid fuel and lighter fraction is subjected to fractional distillation to yield a naphtha fraction and a fraction comprising predominantly $C_2$ to $C_5$ olefins. These olefins may be reacted with isobutane in an acid catalyzed alkylation process to yield alkylate. Alkylate is used for gasoline blending to increase the octane of the motor gasoline pool.

PROCESS CONDITIONS

| | FULL RANGE | PREFERRED RANGE |
|---|---|---|
| Riser Outlet Temp. | 900–1200° F. | 900–1100° F. |
| Regenerator Temp. | 1100–1500° F. | 1200–1350° F. |
| Cat./Oil | 2–15 wt/wt | 4–8 wt/wt |
| Lift Fluid Temp. | Ambient-700° F. | Ambient-300° F. |
| Riser Pressure | 1–7.8 atm. | 1.7–3.2 atm. |
| Residence Time | 0.05–20 sec. | 0.1–5 sec. |

This invention is shown by way of Example.

EXAMPLE

A gas oil having a boiling range of 411° F. to 1087° F. was subjected to fluid catalytic cracking in a commercial FCC unit. The Y-zeolite FCC catalyst had 2 wt % ZSM-5 additive. Catalyst was fluidized with a $C_7$–$C_8$ paraffin injected into the riser as a liquid paraffin-steam mixture. Most of the $C_7$–$C_8$ was normal paraffin. Volumetric ratio of paraffin: steam was 5:1. Paraffin comprised 4.95 vol % of the hydrocarbon in the riser reactor.

Feedstock properties are given in Table 1. Table 2 reports operating conditions and yields for comparative Example 1 and the invention, Example 2. Table 3 reports the calculated cracked paraffin product yield.

It was found that when $C_7$–$C_{10}$ paraffin was used to fluidize catalyst, less coke was produced than with steam fluidization medium. This is evidenced by the reduced regenerator temperature in Example 2. Reduced coke yield also reduces catalyst deactivation rate.

It was found that when $C_7$–$C_8$ paraffin was used to fluidize catalyst, the following advantages compared with steam fluidization medium were realized.

1. The $C_7$–$C_8$ paraffin was converted to $C_2$–$C_5$ olefin.
2. Gas oil conversion was higher and regenerator temperature was lower. The lower regenerator temperature was due to paraffin vaporization and endothermic paraffin cracking resulting in increased catalyst circulation rate. The higher catalyst circulation rate caused increased gas oil conversion at constant riser outlet temperature.
3. Catalyst deactivation rate was reduced. It is well known that contacting of FCC catalyst with high temperature steam results in accelerated catalyst deactivation.

TABLE 1

FEED PROPERTIES

| | GAS OIL | PARAFFIN |
|---|---|---|
| API Gravity | 27.1° | 67.8° |
| Sulfur | 0.282 wt % | — |
| Total Nitrogen | 1.087 wt. ppm | — |
| Carbon Residue | 0.15 wt % | — |
| Reid Vapor Pressure | — | 2.18 psi |
| Distillation | ASTM D-1160 | ASTM D-86 |
| Initial Boiling Point | 411° F. | 194° F. |
| 5 | 540 | 196 |
| 10 | 589 | 197 |
| 20 | 646 | 198 |
| 30 | 684 | 199 |
| 40 | 718 | 201 |
| 50 | 753 | 202 |
| 60 | 791 | 204 |
| 70 | 834 | 208 |
| 80 | 877 | 212 |
| 90 | 938 | 224 |
| 95 | 987 | 249 |
| End Point | 1087 | — |
| RON | — | 56.2 |
| MON | — | 55.0 |
| FIA Aromatics, vol % | — | 0.0 |
| FIA Olefins, vol % | — | 0.0 |

TABLE 2

PRODUCT YIELDS

| | COMPARATIVE EXAMPLE 1 STEAM LIFT FLUID | EXAMPLE 2 4.95 VOL % PARAFFIN LIFT FLUID |
|---|---|---|
| Product Distribution | | |
| $H_2$ | 0.02 wt % | 0.03 wt % |
| $H_2S$ | 0.16 | 0.11 |
| $CH_4$ | 0.38 | 0.99 |
| $C_2$ | 0.28 | 0.71 |
| $C_2^=$ | 0.69 | 1.09 |
| $C_3$ | 1.77 | 1.95 |

TABLE 2-continued

| PRODUCT YIELDS | COMPARATIVE EXAMPLE 1 STEAM LIFT FLUID | EXAMPLE 2 4.95 VOL % PARAFFIN LIFT FLUID |
|---|---|---|
| $C_3^=$ | 6.33 | 6.62 |
| $iC_4$ | 4.57 | 4.62 |
| $nC_4$ | 1.19 | 1.17 |
| $C_4^=$ | 6.73 | 6.63 |
| $iC_5$ | 4.15 | 3.85 |
| $nC_5$ | 0.51 | 0.47 |
| $C_5^=$ | 4.35 | 4.19 |
| $C_6$-430° F. | 38.70 | 39.14 |
| 430° F.–670° F. | 18.70 | 17.25 |
| 670° F.+ | 6.62 | 6.27 |
| Coke | 4.87 | 4.93 |
| Net Gas Oil Conversion, | 74.68 wt % | 75.51 wt % |
| Feed Preheat Temp. | 550° F. | 550° F. |
| Riser Outlet | 991° F. | 991° F. |
| Regenerator Temp. | 1325° F. | 1318° F. |
| Catalyst/Gas Oil | 5.51 wt/wt | 5.80 wt/wt |

TABLE 3

| CRACKED PARAFFIN PRODUCT | |
|---|---|
| Yields | |
| $H_2$ | 1.82 |
| $C_1$ | 6.08 |
| $C_2$ | 7.66 |
| $C_2^=$ | 12.4 |
| $C_3$ | 9.6 |
| $C_3^=$ | 18.48 |
| $iC_4$ | 9.97 |
| $nC_4$ | 2.19 |
| $C_4^=$ | 12.15 |
| $iC_5$ | 3.89 |
| $nC_5$ | 0.43 |
| $C_5^=$ | 1.94 |
| $C_5$-430° F. | 47.16 |
| Conversion ($C_5^-$) | 52.84 vol % |
| RON ($C_5$-430° F.) | 83.1 |

| TABLE OF TEST METHODS | |
|---|---|
| Distillation - | ASTM D-2887, D-1160, D-86 |
| RON - Research Octane Number | ASTM D-2699 |
| MON - Motor Octane Number | ASTM D-2700 |
| FIA - Flame Ionization Analysis | ASTM D-1319 |

While particular embodiments of the invention have been described, it will be understood, of course, that the invention is not limited thereto since many modifications may be made, and it is, therefore, contemplated to cover by the appended claims any such modification as fall within the true spirit and scope of the invention.

What is claimed is:

1. A process for the fluid catalytic cracking of a paraffin fraction comprising:

a. contacting a fluid catalytic cracking catalyst with a lift fluid comprising paraffins in an initial portion of a vertically elongated riser reactor to produce a catalyst suspension wherein said lift gas paraffins consist of $C_7$ to $C_{10}$ paraffins;

b. contacting the catalyst suspension with a petroleum feedstock selected from the group consisting of naphtha, kerosene, diesel oil, gas oil and vacuum gas oil at a riser reactor temperature of about 900° F. (482° C.) to 1200° F. (649° C.) to yield a liquid fuel and lighter fraction; and c. fractionating the liquid fuel and lighter fraction to yield a $C_2$ to $C_5$ olefin fraction and naphtha.

2. The process of claim 1 wherein the lift fluid further includes an inert gas in a volumetric ratio of paraffin:inert gas of 10:1 to 1:10.

3. The process of claim 1 wherein the lift fluid further includes an inert gas in a volumetric ratio of paraffin:inert gas of 10:1 to 2:1.

4. The process of claim 1 wherein the lift fluid further includes an inert gas and wherein said inert gas is selected from the group consisting of steam, nitrogen and mixtures thereof in a volumetric ratio of paraffin:inert gas of 10:1 to 2:1.

5. The process of claim 1 wherein the $C_7$ to $C_{10}$ paraffins consist essentially of normal paraffins.

6. The process of claim 1 wherein the $C_7$ to $C_{10}$ paraffins consist essentially of $C_7$–$C_8$ paraffins.

7. The process of claim 1 wherein the $C_7$ to $C_{10}$ paraffins consist essentially of $C_7$–$C_8$ normal paraffins.

8. The process of claim 1 wherein the petroleum feedstock is selected from the group consisting of gas oil, vacuum gas oil and mixtures thereof.

9. The process of claim 1 wherein the petroleum feedstock is gas oil.

* * * * *